US009643446B2

(12) United States Patent
Carroll

(10) Patent No.: US 9,643,446 B2
(45) Date of Patent: May 9, 2017

(54) CLIP-LESS CLIPBOARD

(71) Applicant: Margie K. Carroll, Canton, GA (US)

(72) Inventor: Margie K. Carroll, Canton, GA (US)

( * ) Notice: Subject to any disclaimer, the term of this patent is extended or adjusted under 35 U.S.C. 154(b) by 412 days.

(21) Appl. No.: 14/566,665

(22) Filed: Dec. 10, 2014

(65) Prior Publication Data

US 2016/0167423 A1 Jun. 16, 2016

(51) Int. Cl.
*B42F 9/00* (2006.01)
*B42F 1/06* (2006.01)

(52) U.S. Cl.
CPC ..... *B42F 9/002* (2013.01); *B42F 9/001* (2013.01); *B42F 9/005* (2013.01)

(58) Field of Classification Search
CPC .. B42F 9/001; B42F 9/005; B42F 1/06; Y10T 24/202
USPC ..... 248/441.1, 442.2, 451, 316.7, 684; 24/115 R, 437, 455
See application file for complete search history.

(56) References Cited

U.S. PATENT DOCUMENTS 2,322,259 A * 6/1943 Thurston ..... B41J 29/15 40/352
3,085,579 A 4/1963 Ensign
4,645,163 A * 2/1987 Zovar ..... A47B 23/042 248/452
D298,955 S 12/1988 Zovar
4,948,172 A 8/1990 Chang
D313,819 S 1/1991 Craft, Jr.
D315,456 S 3/1991 Couch
D321,012 S 10/1991 Wright
5,058,242 A 10/1991 Liu
5,324,076 A 6/1994 Nieradka
D349,731 S 8/1994 Leveen
5,487,521 A * 1/1996 Callahan ..... B60N 3/005 248/441.1
5,680,973 A 10/1997 Vulpitta
6,971,616 B1 12/2005 Lake
6,988,646 B2 * 1/2006 White ..... A63B 57/203 206/315.1
D537,120 S 2/2007 Mandel
D595,357 S 6/2009 Simpson
D661,354 S 6/2012 Karnis
8,397,963 B2 * 3/2013 Singh ..... B60N 3/004 224/275

(Continued)

*Primary Examiner* — Tan Le
(74) *Attorney, Agent, or Firm* — Crose Law LLC; Bradley D. Crose

(57) ABSTRACT

A clip-less clipboard device is disclosed having a clipboard surface having: a first planer surface area; a second planar surface area generally parallel to the first surface area and generally equidistant apart from the first surface area at a predetermined distance; a plurality of flutes disposed within the first surface area and the second surface area and generally perpendicular to the first surface area and the second surface area; and a corrugated core disposed within each of the plurality of flutes, thereby to create a plurality of hollow channels within the flutes within the first surface area and the second surface area, and wherein each channel runs a continuous length within the first surface area and the second surface area; and a slit defined on the first planer surface area of the clipboard surface and configured to hold an article of paper upon the first planer surface area.

20 Claims, 13 Drawing Sheets

(56) References Cited

U.S. PATENT DOCUMENTS

| | | | | |
|---|---|---|---|---|
| 2004/0069661 | A1* | 4/2004 | Telleen | B65D 5/4233 206/232 |
| 2016/0167423 | A1* | 6/2016 | Carroll | B42F 9/002 281/45 |
| 2016/0318661 | A1* | 11/2016 | Simakis | A45F 5/021 |
| 2017/0043226 | A1* | 2/2017 | Bryant | A63B 57/203 |

* cited by examiner

CLIP-LESS CLIPBOARD

FIELD OF THE INVENTION

The technology described herein relates generally to the fields of clipboards, pen and pencil holders, lap desks, and the like. More specifically the technology described herein relates to a clip-less clipboard with a multiplicity of add-on features selectable by the user. Furthermore, technology described herein relates to a clip-less clipboard system having elements that enable the distributor and/or user to fashion a variety of configurations based on design choice and other factors.

BACKGROUND OF THE INVENTION

Certain clipboards, pen and pencil holders, and lap desks are known in the background art. Known devices and systems are inefficient and limiting in many ways. Others have attempted to overcome these deficiencies with new clipboards, pen and pencil holders, and lap desks; however, these devices also have been found to have various shortcomings and deficiencies as well.

Related utility patents known in the art include the following:

U.S. Pat. No. 5,680,973, issued to Vulpitta et al. on Oct. 28, 1997, discloses a portable children's activity station.

U.S. Pat. No. 5,324,076, issued to Nieradka on Jun. 28, 1994, discloses a clip board with storage drawer.

U.S. Pat. No. 4,948,172, issued to Chang on Aug. 14, 1990, discloses a combined clip board and pen holder.

U.S. Pat. No. 5,058,242, issued to Liu et al. on Oct. 22, 1991, discloses a pen holder for a clip board.

U.S. Pat. No. 4,645,163 issued to Zovar on Feb. 24, 1987, discloses a clip board desk and stand.

U.S. Pat. No. 3,085,579, issued to Ensign et al. on Mar. 1, 1961, discloses a roller clip board.

U.S. Pat. No. 6,971,616 issued to Lake on Dec. 6, 2005, discloses a clipboard.

Related utility patents known in the art include the following:

U.S. Pat. No. Des. 315,456 issued to Couch et al. on Mar. 19, 1991, discloses a lap desk.

U.S. Pat. No. Des. 349,731 issued to Levee et al. on Aug. 16, 1994, discloses a clip board.

U.S. Pat. No. Des. 321,012 issued to Wright on Oct. 22, 1991, discloses an automotive clip board.

U.S. Pat. No. Des. 313,819 issued to Craft, Jr. et al. on Jan. 15, 1991, discloses a clip board.

U.S. Pat. No. Des. 298,955 issued to Zovar on Dec. 13, 1988, discloses a clip board.

U.S. Pat. No. Des. 537,120 issued to Mandel on Feb. 20, 2007, discloses a clipboard.

U.S. Pat. No. Des. 595,357 issued to Simpson on Jun. 30, 2009, discloses a clipboard.

U.S. Pat. No. Des. 661,354 issued to Karnis on Jun. 5, 2012, discloses a clipboard.

The foregoing patent and other information reflect the state of the art of which the inventor is aware and are tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides a clip-less clipboard with a multiplicity of add-on features selectable by the user and a clip-less clipboard system having elements that enable the distributor and/or user to fashion a variety of configurations based on design choice and other factors.

In one exemplary embodiment, the technology described herein provides a clip-less clipboard device having a clipboard surface having: a first planer surface area; a second planar surface area generally parallel to the first surface area and generally equidistant apart from the first surface area at a predetermined distance; a plurality of flutes disposed within the first surface area and the second surface area and generally perpendicular to the first surface area and the second surface area; and a corrugated core disposed within each of the plurality of flutes, thereby to create a plurality of hollow channels within the flutes within the first surface area and the second surface area, and wherein each channel runs a continuous length within the first surface area and the second surface area; and a slit defined on the first planer surface area of the clipboard surface and configured to hold an article of paper upon the first planer surface area.

In at least one embodiment the clip-less clipboard device also includes a base coupled to a bottom surface area of the clipboard surface and at a generally perpendicular angle to the clipboard surface, and through at least one hollow channel, thereby configured to hold the clip-less clipboard device in an upright, stable position.

In at least one embodiment the clip-less clipboard device also includes a cord, coupled to the clipboard surface and configured to tether the clip-less clipboard device; and at least one bead through which the cord is coupled to itself and by which a length of the cord is adjusted. The cord is adjustable in length by placement of the bead along at a preferred destination along the cord.

In at least one embodiment the clip-less clipboard device also includes a pencil or pen holder defined within the plurality of hollow channels of the clipboard surface; and at least one pen or pencil disposed within at least one of the plurality of hollow channels of the clipboard surface.

In at least one embodiment the clip-less clipboard device also includes a supplemental marker holder configured to couple to the clipboard surface through one or more of the plurality of hollow channels of the clipboard surface; and at least one marker for placement within a cavity of the supplemental marker holder.

In at least one embodiment the clip-less clipboard device also includes a light disposed upon the clipboard surface and configured to provide illumination to a user of the clip-less clipboard device when in use.

In at least one embodiment the clip-less clipboard device also includes a band configured for horizontal, circumnavigated placement around the clipboard surface and with which to secure one or more sheets of paper to the clip-less clipboard device in addition to the slit.

In at least one embodiment the clip-less clipboard device also includes a straight edge. In at least one embodiment, the straight edge is configured to couple to the clip-less clipboard device utilizing at least one of the hollow channels. In at least one embodiment, the straight edge is configured to couple to the clip-less clipboard device utilizing the base. In at least one embodiment, the straight edge further comprises a plurality of apertures such that the straight edge, along with at least one writing instrument is usable as a compass.

In at least one embodiment the clip-less clipboard device also includes a ruler configured to couple to the clip-less clipboard device.

In at least one embodiment the clip-less clipboard device also includes a marker pull-out tray configured to couple to the clipboard surface through one or more of the plurality of hollow channels of the clipboard surface.

In at least one embodiment the clip-less clipboard device also includes a plurality of crayons contained and configured to couple to the clip-less clipboard device.

In at least one embodiment, the clip-less clipboard device is comprised of plastic.

In at least one embodiment the clip-less clipboard device is entirely washable.

In another exemplary embodiment, a clip-less clipboard device with breakaway tethering cord includes: a clipboard surface having: a first planer surface area; a second planar surface area generally parallel to the first surface area and generally equidistant apart from the first surface area at a predetermined distance; a plurality of flutes disposed within the first surface area and the second surface area and generally perpendicular to the first surface area and the second surface area; and a corrugated core disposed within each of the plurality of flutes, thereby to create a plurality of hollow channels within the flutes within the first surface area and the second surface area, and wherein each channel runs a continuous length within the first surface area and the second surface area; a slit defined on the first planer surface area of the clipboard surface and configured to hold an article of paper upon the first planer surface area; a breakaway, pre-cut cord, coupled to the clipboard surface and configured to tether the clip-less clipboard device; at least one bead through which the cord is coupled to itself and by which a length of the cord is adjusted. The cord is adjustable in length by placement of the bead along at a preferred destination along the cord; and wherein while in use a force pulls upon the clip-less clipboard device the cord will breakaway to not injure the user.

In another exemplary embodiment, a combined clipboard device and pull-out marker tray includes: a clipboard surface having: a first planer surface area; a second planar surface area generally parallel to the first surface area and generally equidistant apart from the first surface area at a predetermined distance; a plurality of flutes disposed within the first surface area and the second surface area and generally perpendicular to the first surface area and the second surface area; and a corrugated core disposed within each of the plurality of flutes, thereby to create a plurality of hollow channels within the flutes within the first surface area and the second surface area, and wherein each channel runs a continuous length within the first surface area and the second surface area; and a marker pull-out tray configured to couple to the clipboard surface through one or more of the plurality of hollow channels of the clipboard surface.

In at least one embodiment, the combined clipboard device and pull-out marker tray also includes: a cord, coupled to the clipboard surface and configured to tether the clip-less clipboard device; and at least one bead through which the cord is coupled to itself and by which a length of the cord is adjusted. The cord is adjustable in length by placement of the bead along at a preferred destination along the cord.

In at least one embodiment, the combined clipboard device and pull-out marker tray also includes a plurality of markers.

Advantageously, the technology described herein provides a clip-less clipboard with a multiplicity of add-on features selectable by the user and a clip-less clipboard system having elements that enable the distributor and/or user to fashion a variety of configurations based on design choice and other factors.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a clip-less clipboard with a multiplicity of add-on features selectable by the user. The technology described herein provides a clip-less clipboard system having elements that enable the distributor and/or user to fashion a variety of configurations based on design choice and other factors.

Referring now to the figures, a clip-less clipboard device 10 is shown. The clip-less clipboard device 10 includes a clipboard surface having a first planer surface area 12. The clip-less clipboard device 10 also includes a second planar surface 13 area generally parallel to the first surface area 12 and generally equidistant apart from the first surface area 12 at a predetermined distance. The first planer surface area 12 is depicted in the Figures as the front side of the clip-less clipboard device 10. The second planar surface 13 area is depicted in the Figures as the back side of the clip-less clipboard device 10.

Figure 1:
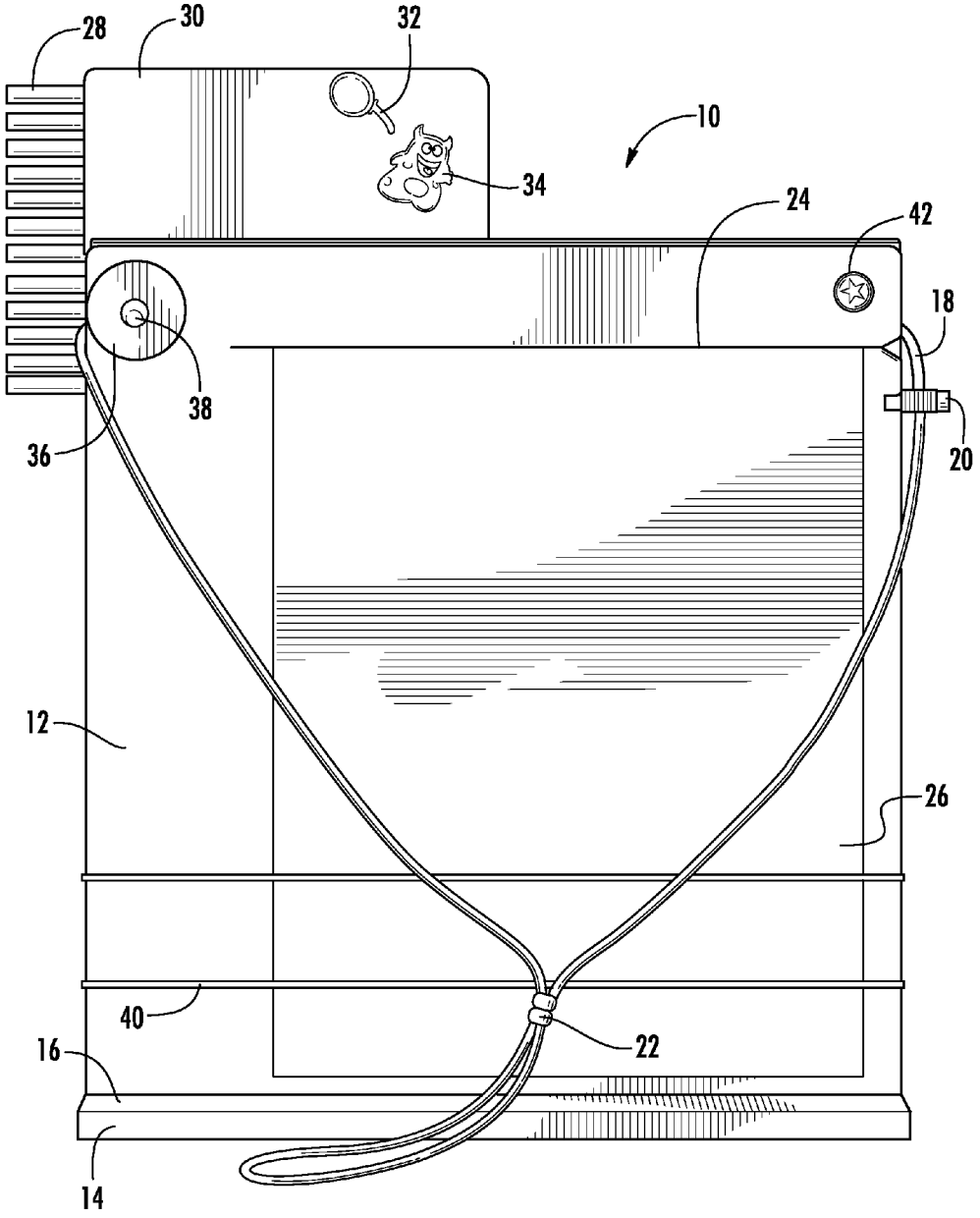
FIG. 1 is a front planar view of a clip-less clipboard device, illustrating, in particular, a writing surface, device base, tethered cord, pencil holder, marker holder, paper-holding band, light and decorations, according to an embodiment of the technology described herein.

In various embodiments, the clip-less clipboard device 10 includes one or more decorations or aesthetic add-ons. By way of example, and as depicted in FIG. 1, the clip-less clipboard device 10 includes a first decoration 32, a helium balloon, a second decoration 34, a monster character, and a third decoration 42, a star. As will be apparent to the reader of this disclosure, such decorations 32, 34, 42, for example, can vary based on customization and personal preference of the user. By way of example, such decorations 32, 34, 42 can include removable stickers, decals, post-its, and so forth. Further, such decorations 32, 34, 42 may be temporary such as those made by dry-erase markers.

Figure 2:
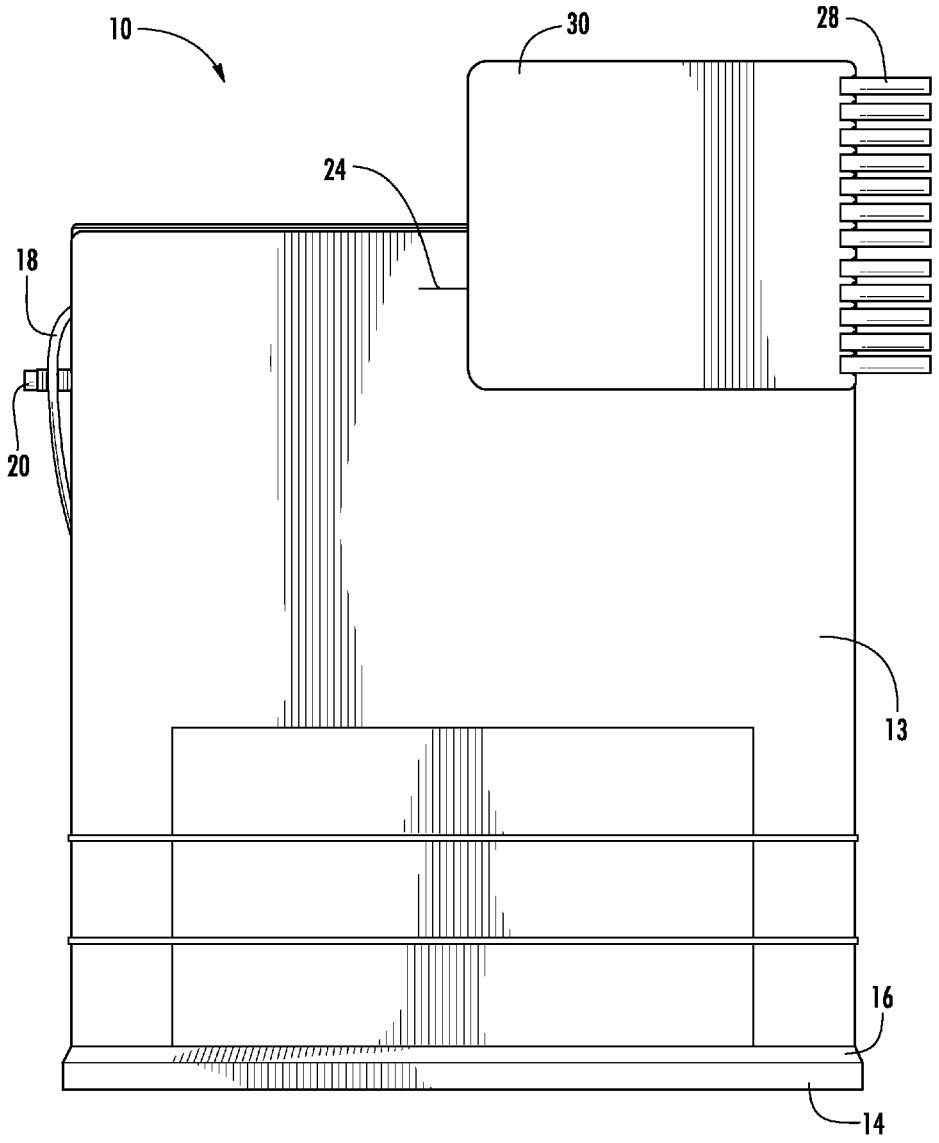
FIG. 2 is a rear planar view of the clip-less clipboard device depicted in FIG. 1, illustrating, in particular, a writing surface, device base, tethered cord, pencil holder, marker holder, paper-holding band, light and decorations, according to an embodiment of the technology described herein.
Figure 3:
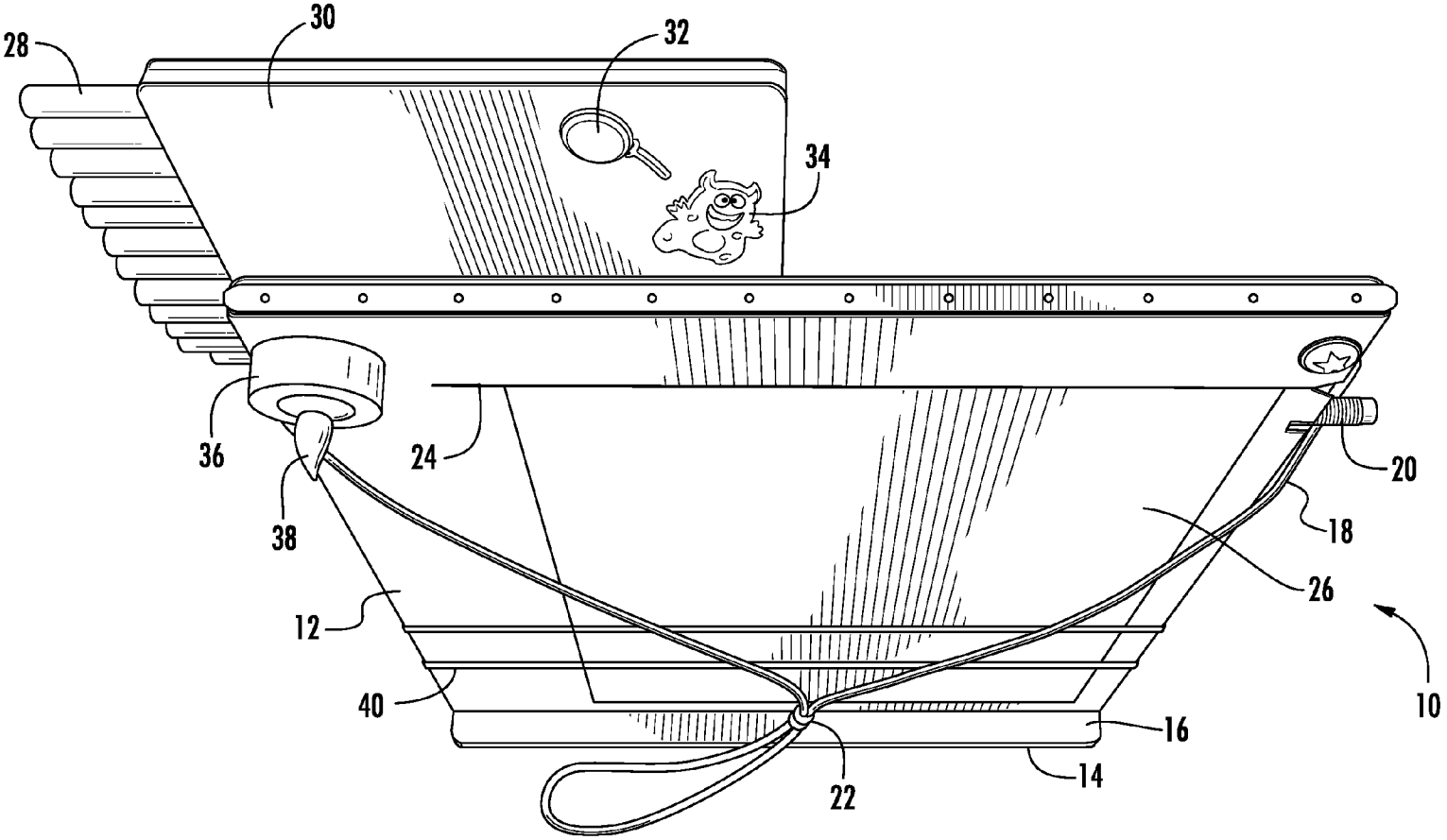
FIG. 3 is a top perspective view the clip-less clipboard device depicted in FIG. 1, illustrating, in particular, a writing surface, device base, tethered cord, pencil holder, marker holder, paper-holding band, light and decorations, according to an embodiment of the technology described herein.

The clip-less clipboard device 10 includes a multiplicity of flutes 15. The multiplicity of flutes is disposed within and between the first surface area 12 and the second surface area 13. The first surface area 12 is depicted well in FIG. 1. The second surface area 13 is depicted well in FIG. 2. The multiplicity of flutes 15 is generally perpendicular to the first surface area 12 and the second surface area 13. There is a corrugated core disposed within each of the multiplicity of flutes 15, thereby to create a multiplicity of hollow channels 44 within the flutes within the first surface area 12 and the second surface area 13. As depicted is the side view of FIG. 9, the multiplicity of flutes 15 and the multiplicity of hollow channels 44 are shown between the first surface area 12 and the second surface area 13.

Each hollow channel 44 runs a continuous length within the first surface area 12 and the second surface area 13. By way of example, cord 18, discussed later, runs through the length of one hollow channel 44, as depicted is the side view of FIG. 9, to couple to the clip-less clipboard device 10 to tether it for use and for carrying or hanging.

Figure 7:
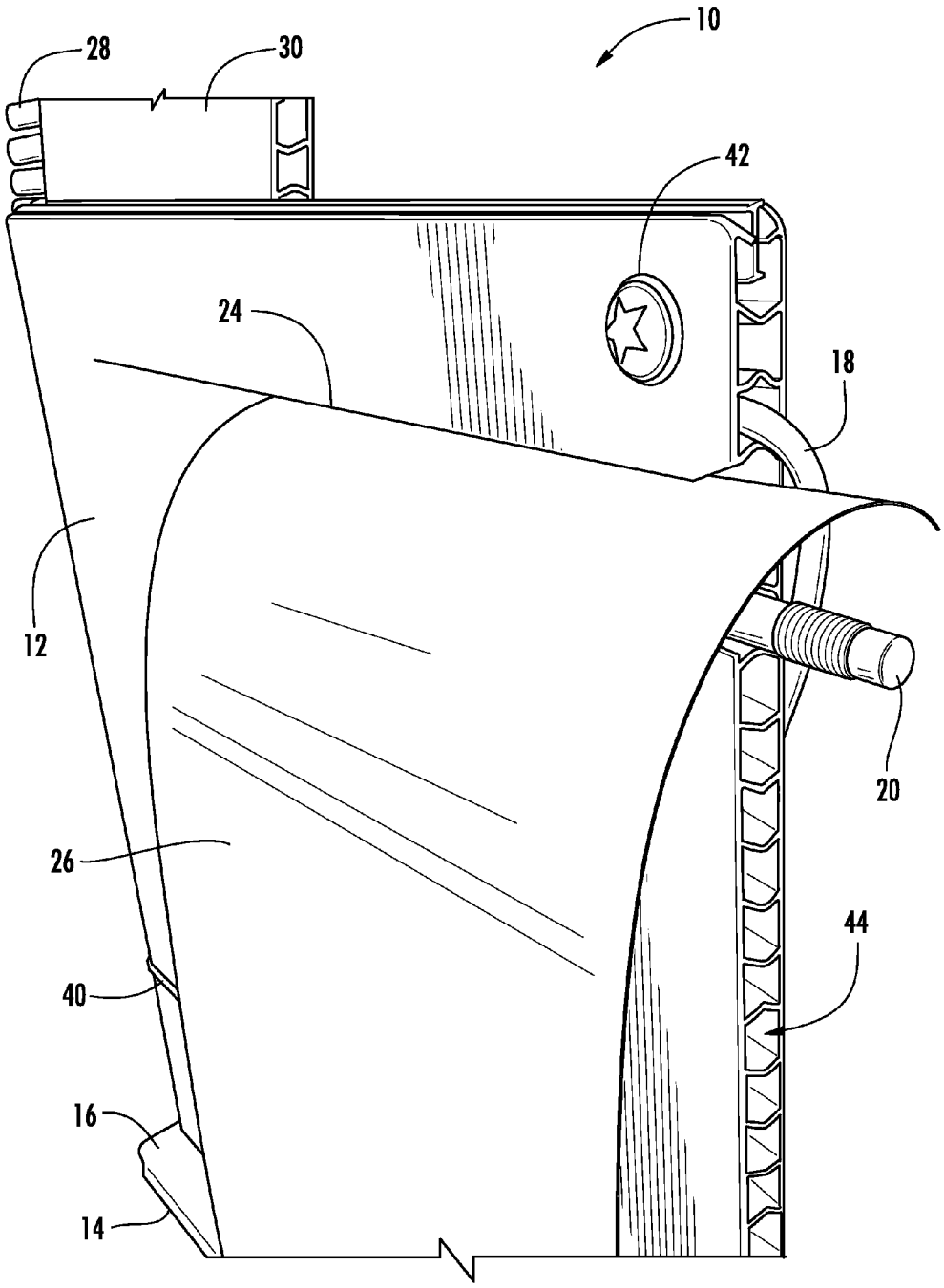
FIG. 7 is a close-up side perspective view of the clip-less clipboard device depicted in FIG. 1, illustrating, in particular, a writing surface, device base, tethered cord, pencil holder, marker holder, paper-holding band, and the plurality of cavities, according to an embodiment of the technology described herein.

The clip-less clipboard device 10 includes a slit 24 cut and defined on the first planer surface area 12 of the clipboard surface. The slit 24 is configured to hold an article of paper, such as paper 26 for example, upon the first planer surface area 12. Paper 26 is shown held in place in the slit 24 in FIGS. 1 and 4 for example. Additionally, in the perspective view of FIG. 7, from the side, the paper 26 is shown inserted into slit 24. The slit can be at a predetermined angle to the device 10 to further aid in secure the paper 26. The paper 26 is then pushed downwardly onto front surface 12 whereupon a user can write or draw on the paper 26. Thus, the clipboard is "clip-less" yet serves to securely hold paper 26 type items in place for the user and without the additional hardware use in bulky clipboards that often require heavy and/or metal components. Additionally, paper 26 can be further secured under one or more bands 40 that horizontally circle the clip-less clipboard device 10.

Figure 8:
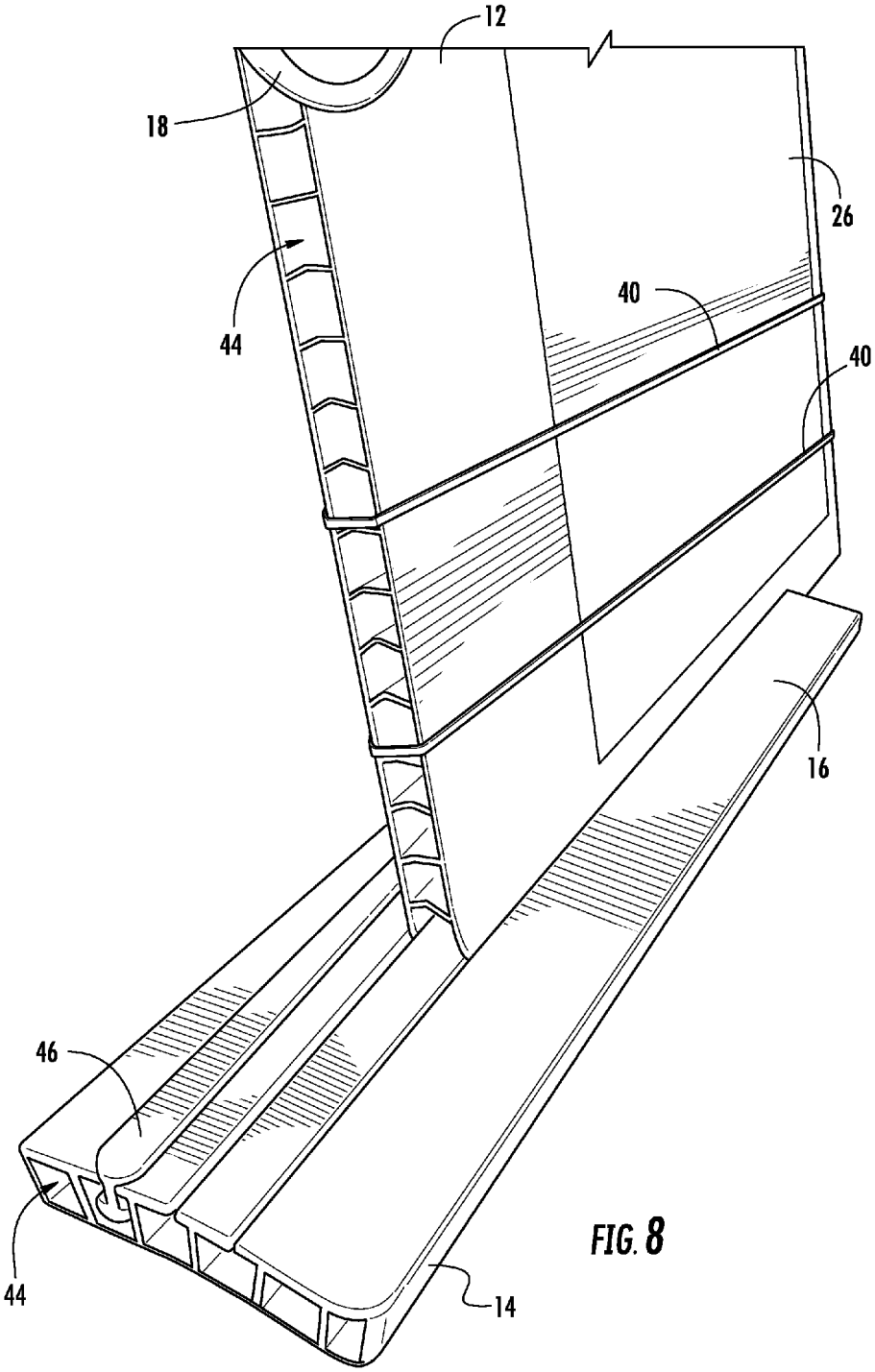
FIG. 8 is a close-up side perspective view of the clip-less clipboard device depicted in FIG. 1, illustrating, in particular, the device base, its cavities, and a straight edge device, according to an embodiment of the technology described herein.
Figure 9:
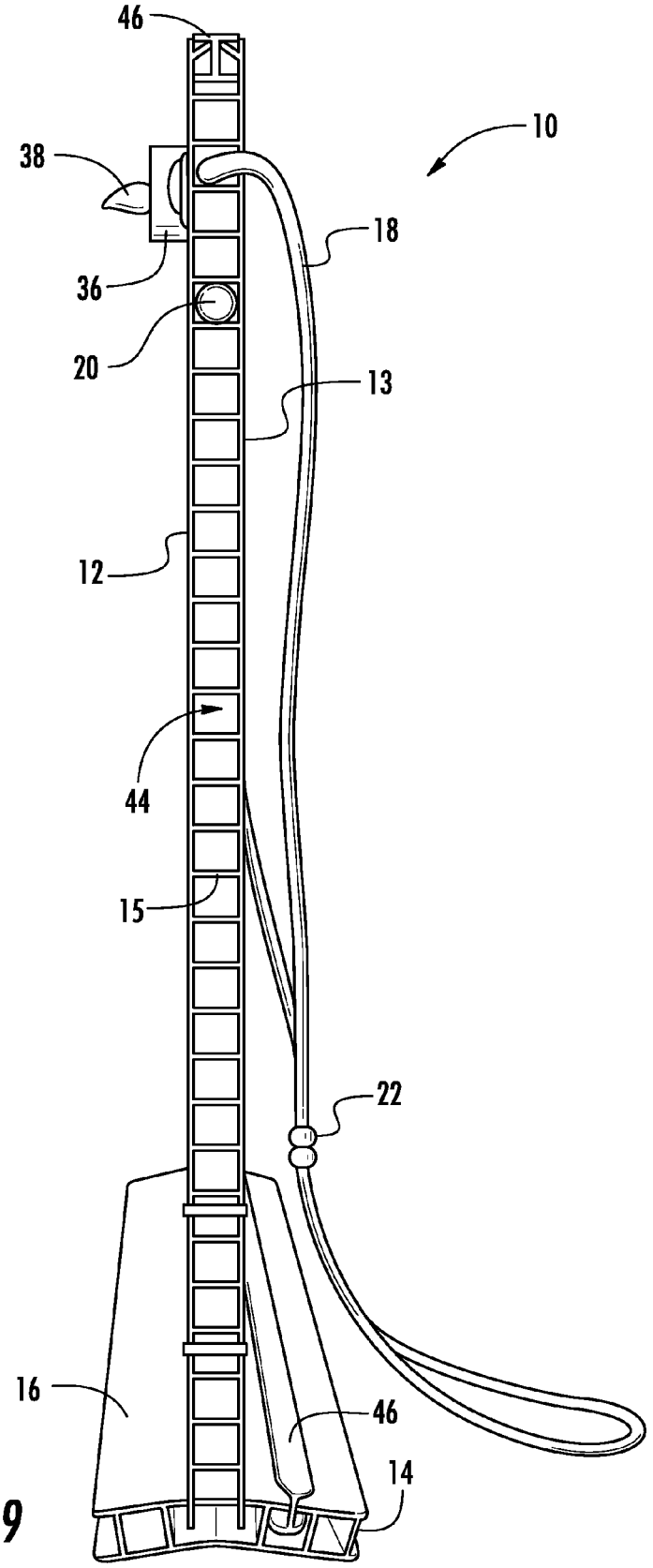
FIG. 9 is a side view of the clip-less clipboard device depicted in FIG. 1, illustrating, in particular, the device base, tethered cord, pencil holder, paper-holding band, light, straight edge, and the plurality of cavities, according to an embodiment of the technology described herein.

In at least one embodiment the clip-less clipboard device 10 also includes a base 16, having edge 14. The base 16 is coupled to a bottom surface area of the clipboard surface and at a generally perpendicular angle to the clipboard surface. The base 16 can couple, for example, through at least one hollow channel, 44 in the base 16, thereby configured to hold the clip-less clipboard device 10 in an upright, stable position, as depicted in FIG. 1, for example. FIG. 9 shows from a side view the coupled of the base 16 to the vertical components and illustrates how the device is self-supporting like a stand. FIG. 8 depicts the means and method by which the base 16 is attached to the vertical components through the multiplicity of hollow channels 44.

In at least one embodiment the clip-less clipboard device 10 also includes a cord 18. The cord 18 is made of a soft fabric like material in at least one embodiment. The cord 18 is stretchable in at least one embodiment. The cord 18 is coupled to the clipboard surface and configured to tether the clip-less clipboard device 10.

In at least one embodiment, the the clip-less clipboard device 10 further includes at least one bead 22 through which the cord 18 is coupled to itself and by which a length of the cord 18 is adjusted. The cord 18 is adjustable in length by placement of the bead 22 or beads along the cord 18 at a preferred destination along the cord 18. As depicted in FIG. 1, for example, the cord 18 is secured by beads 22 at a predetermined length by the user.

In at least one embodiment the clip-less clipboard device 10 also includes a pencil or pen holder or crayon holder or marker holder defined within the multiplicity of hollow channels 44 of the clipboard surface. By way of example and illustration, at least one pen or pencil 29 is shown in FIG. 1 disposed within at least one of the plurality of hollow channels 44 of the clipboard surface. The pencil 20 easily slides in and out of the hollow channel 44 into which it is placed. However, the hollow channel 44 is dimensioned such that the pencil 20 is securely and snuggly held in place and does not fall out unintentionally.

Figure 4:
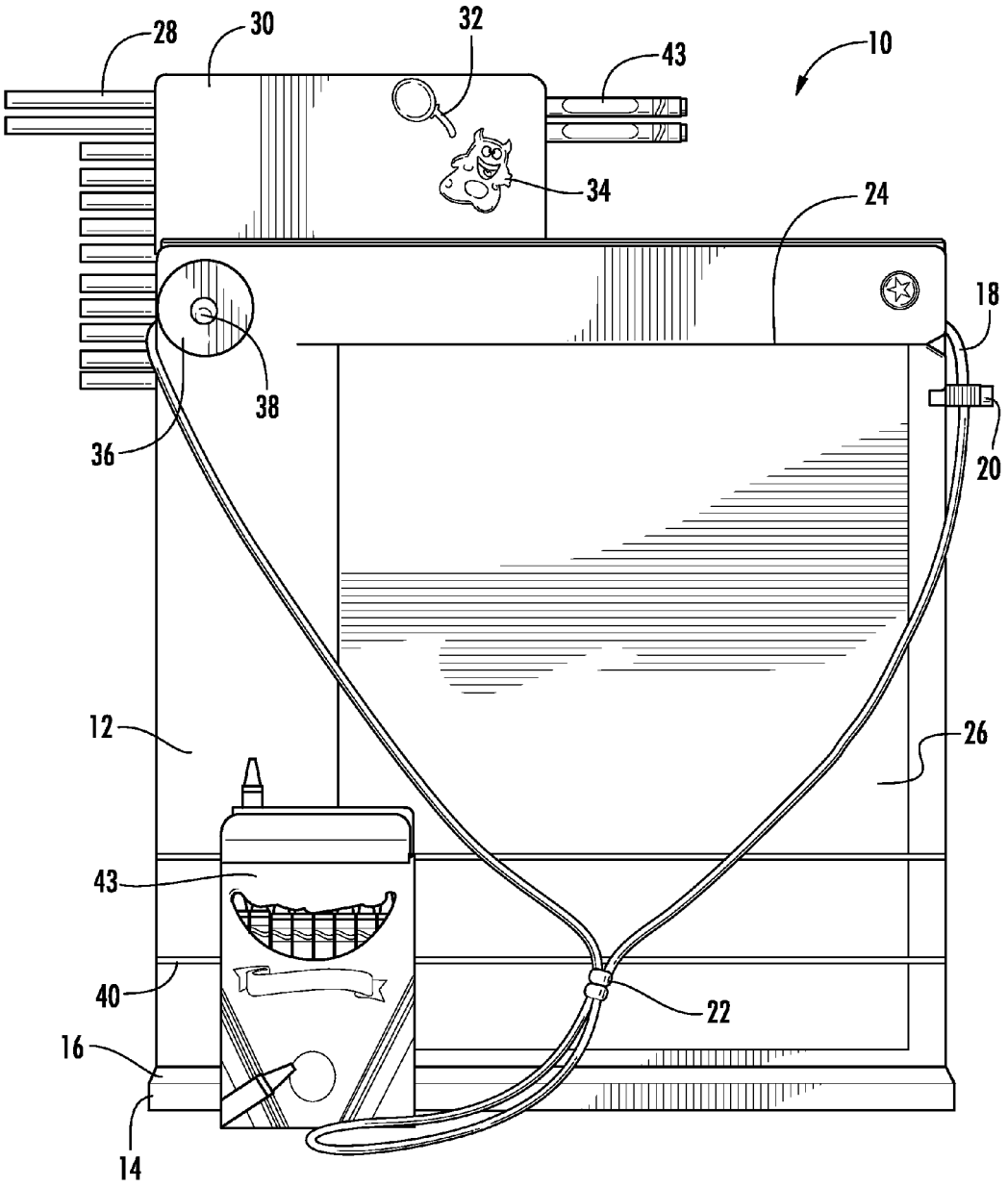
FIG. 4 is a front planar view of the clip-less clipboard device depicted in FIG. 1, illustrating, in particular, utilization of the marker holder, according to an embodiment of the technology described herein.
Figure 5:
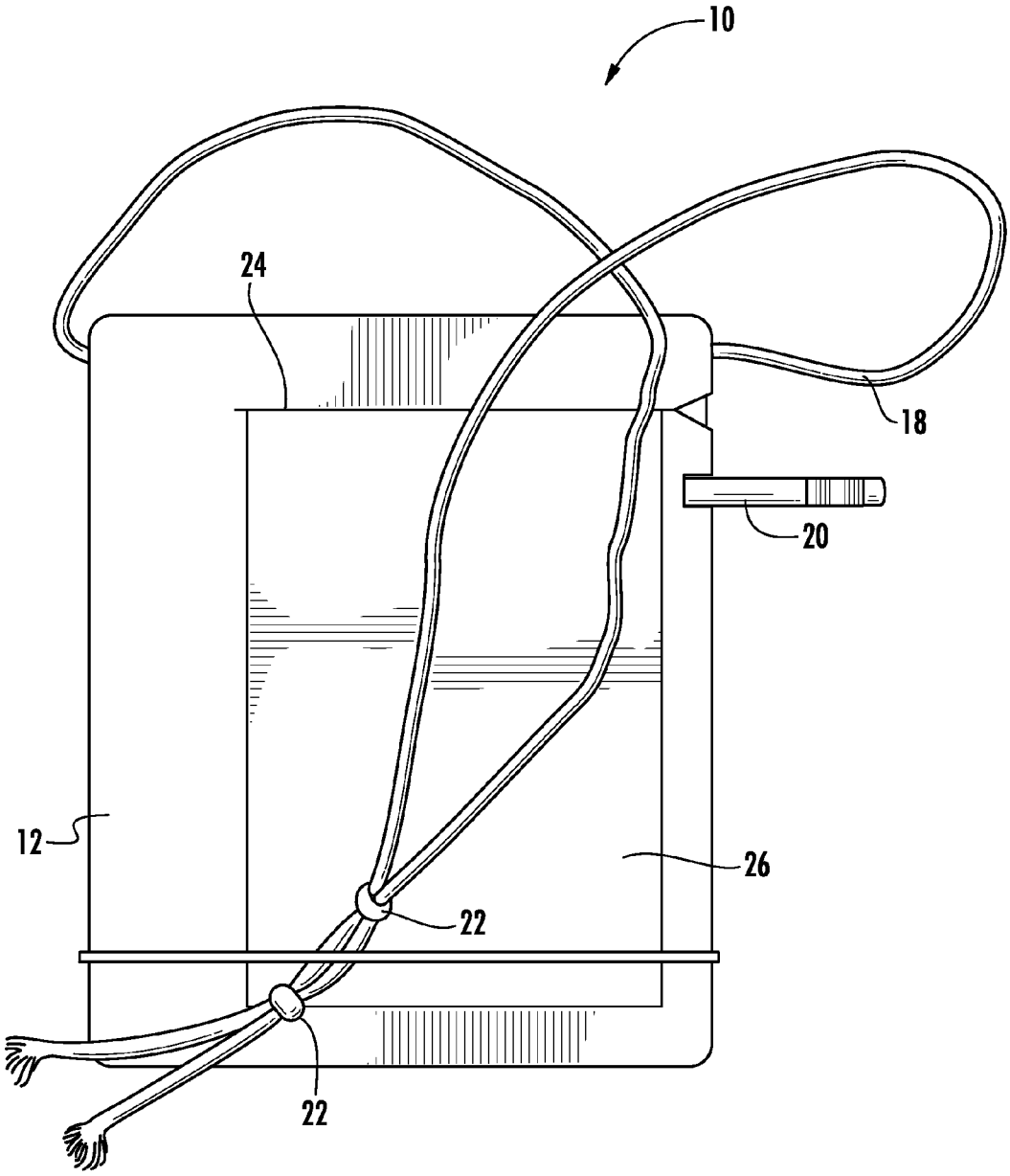
FIG. 5 is a front planar view of an alternative clip-less clipboard device, illustrating, in particular, a writing surface, tethered separated cord, pencil holder, and paper-holding band, according to an embodiment of the technology described herein.
Figure 6:
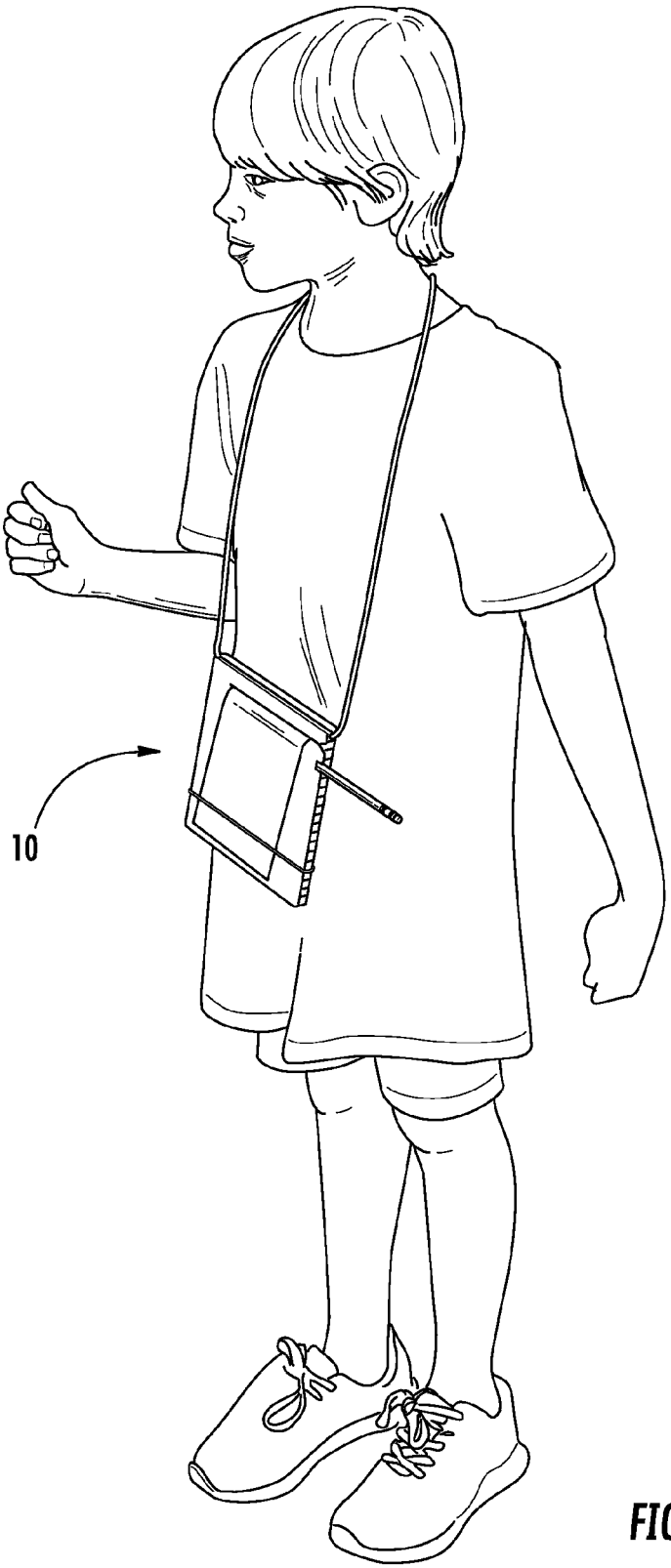
FIG. 6 is a front perspective view showing the alternative clip-less clipboard device depicted in FIG. 5 in use, according to an embodiment of the technology described herein.

In at least one embodiment the clip-less clipboard device 10 also includes a supplemental marker holder 30. The supplemental marker holder 30 is configured to couple to the clipboard surface through one or more of the plurality of hollow channels 44 of the clipboard surface. In at least one embodiment, the clip-less clipboard device 10 also includes at least one marker 28, or like writing instrument, for placement within a cavity of the supplemental marker holder 30. By way of example, FIG. 4 depicts supplemental marker holder 30 shown holding both pens 28 and crayons 43.

In at least one embodiment the clip-less clipboard device also includes a light 38. By way of example, the light 38 is depicted in Figure disposed upon on a base 36, which is disposed upon the clipboard surface. The light 38 is configured to provide illumination to a user of the clip-less clipboard device when in use. By way of example, the light 38 is push-button activated in at least one embodiment. By way of example, the light 38 is powered by a power source internal to the base 36, such as a battery like a watch battery.

In at least one embodiment the clip-less clipboard device 10 also includes one or more bands 40. The bands 40 are rubber bands in at least one embodiment. The bands 40 are elastic bands in at least one embodiment. Each band 40 is configured for horizontal, circumnavigated placement around the clipboard surface and with which to secure one or more sheets of paper 26 to the clip-less clipboard device 10 in addition to being secured within the slit 24 on the clipboard surface 12. As depicted in FIG. 1, two bands 40 are shown with horizontal, circumnavigated placement around the clipboard surface.

Figure 10:
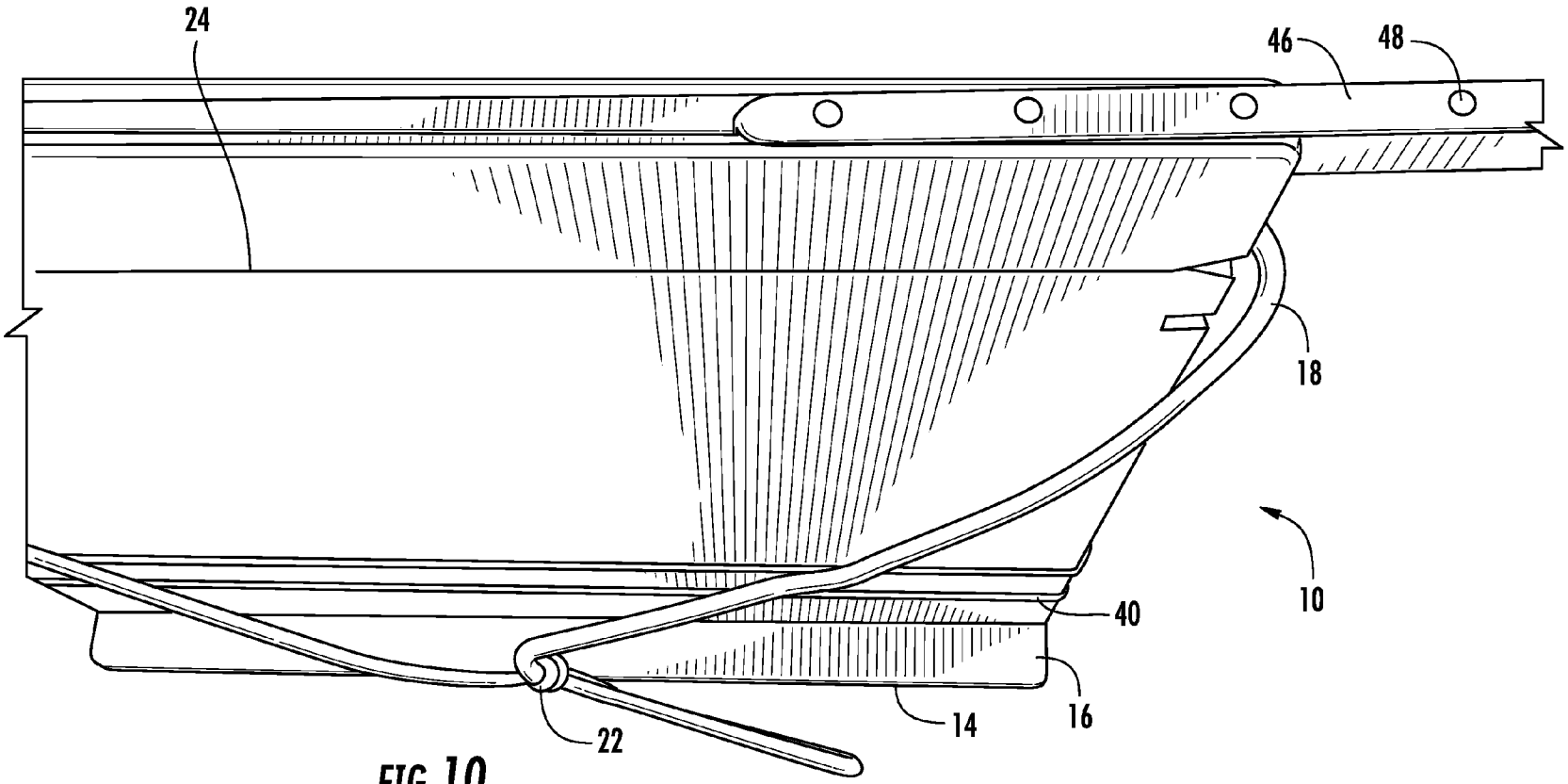
FIG. 10 is a top view of the clip-less clipboard device depicted in FIG. 1, illustrating, in particular, the device base, tethered cord, pencil holder, paper-holding band, light, and the straight edge across the top, according to an embodiment of the technology described herein.

In at least one embodiment the clip-less clipboard device 10 also includes a straight edge 46. In at least one embodiment, the straight edge 46 is configured to couple to the clip-less clipboard device 10 utilizing at least one of the hollow channels 44. In at least one embodiment, the straight edge 46 is configured to couple to the clip-less clipboard device 10 utilizing the base 16, as depicted in FIG. 9. In at least one embodiment, the straight edge 46 is configured to couple to the clip-less clipboard device 10 utilizing a coupling to the top of the clip-less clipboard device 10, as depicted in FIG. 10.

Figure 11:
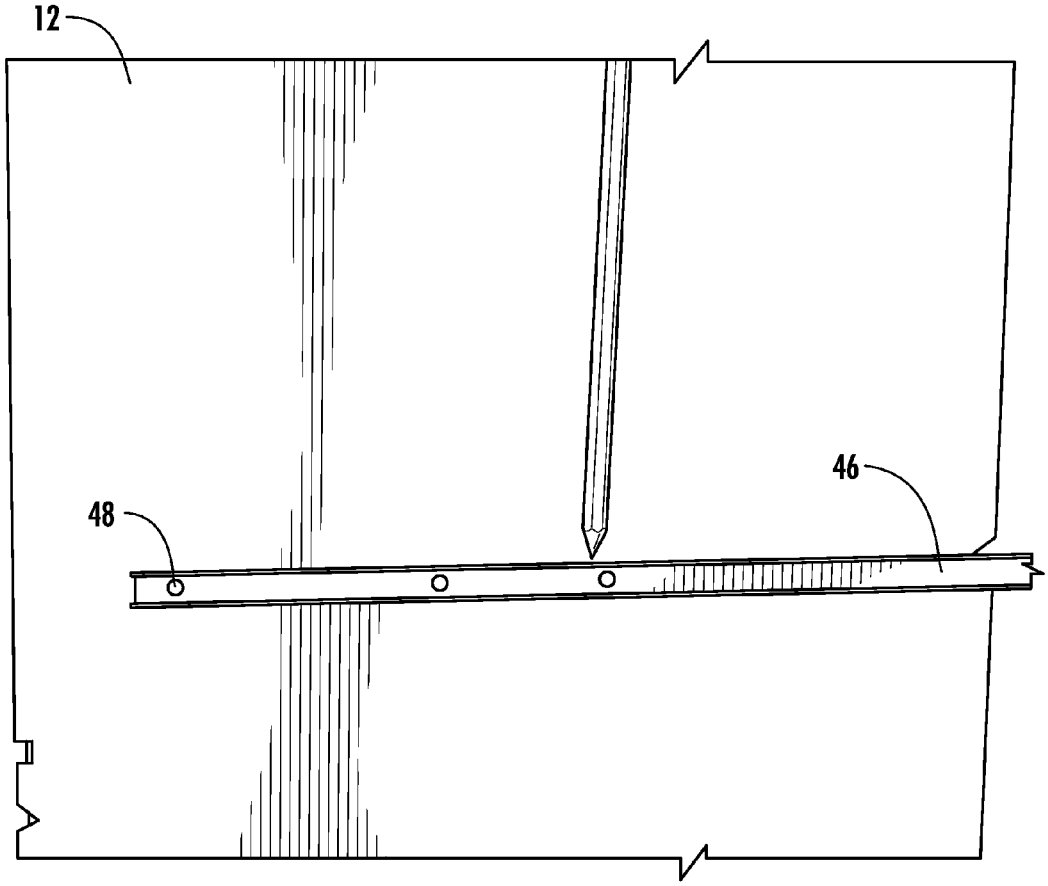
FIG. 11 is a front view of the straight edge and its apertures, shown in use, according to an embodiment of the technology described herein.
Figure 12:
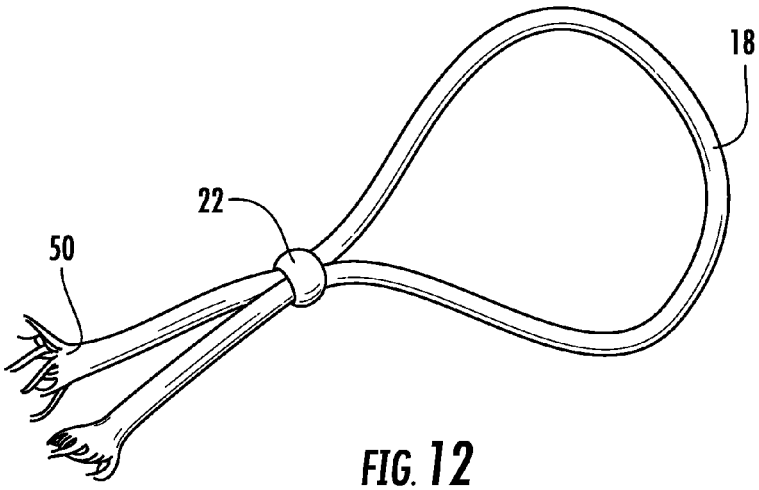
FIG. 12 is a front perspective view of the tethered cord, its cut ends, and bead, according to an embodiment of the technology described herein.

In at least one embodiment, the straight edge 46 further comprises a multiplicity of apertures 48 such that the straight edge 46, along with at least one writing instrument 20 is usable as a compass, as depicted for example in FIG. 11.

In at least one embodiment the clip-less clipboard device 10 also includes a ruler configured to couple to the clip-less clipboard device 10. The ruler is formed in at least one embodiment by adding the ruler markings to the straight edge 46.

Figure 13:
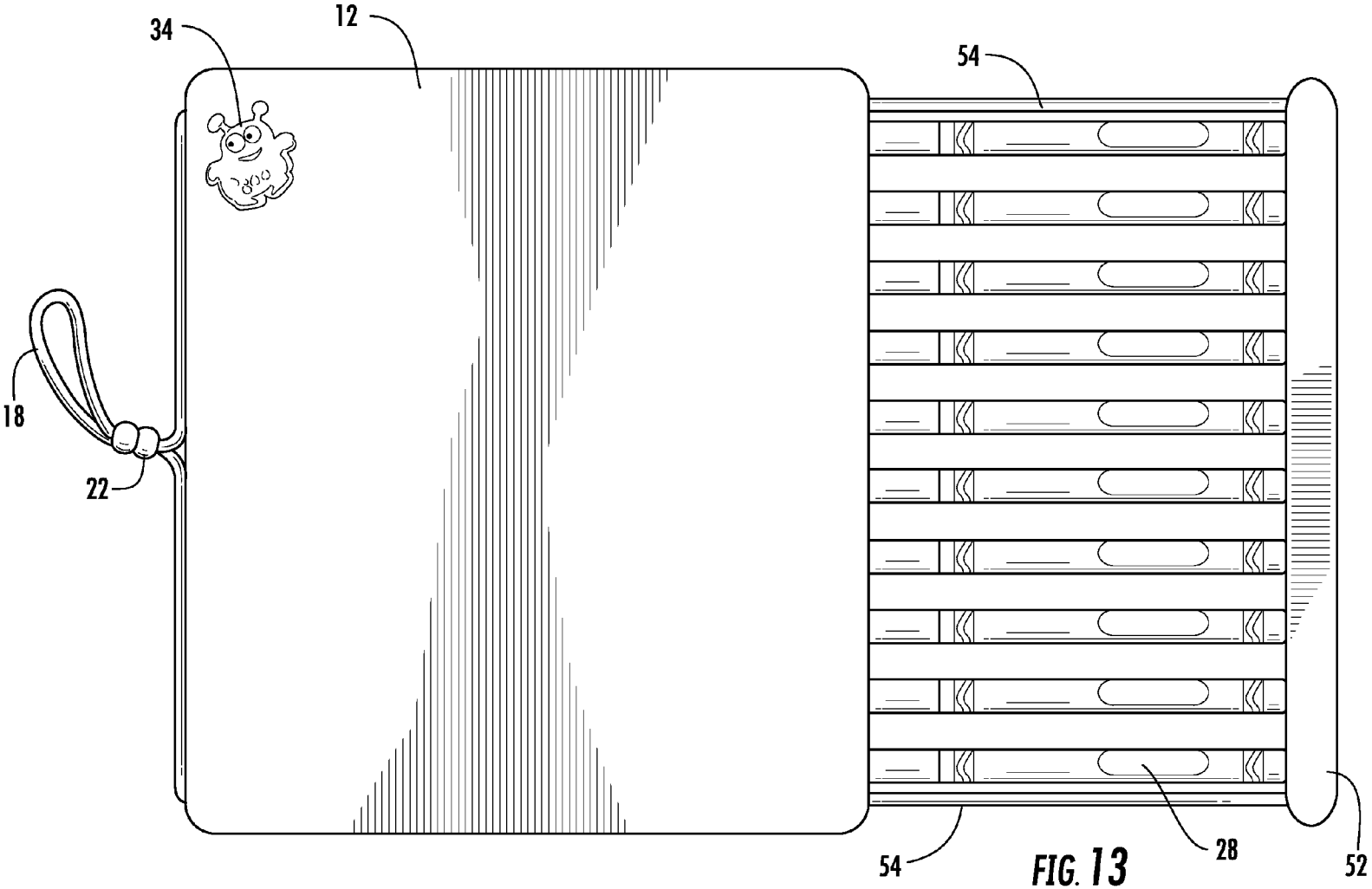
FIG. 13 is a front planar view of an alternative clip-less clipboard device, illustrating, in particular, a writing surface, tethered cord, and extendable marker holder, according to an embodiment of the technology described herein.
Figure 14:
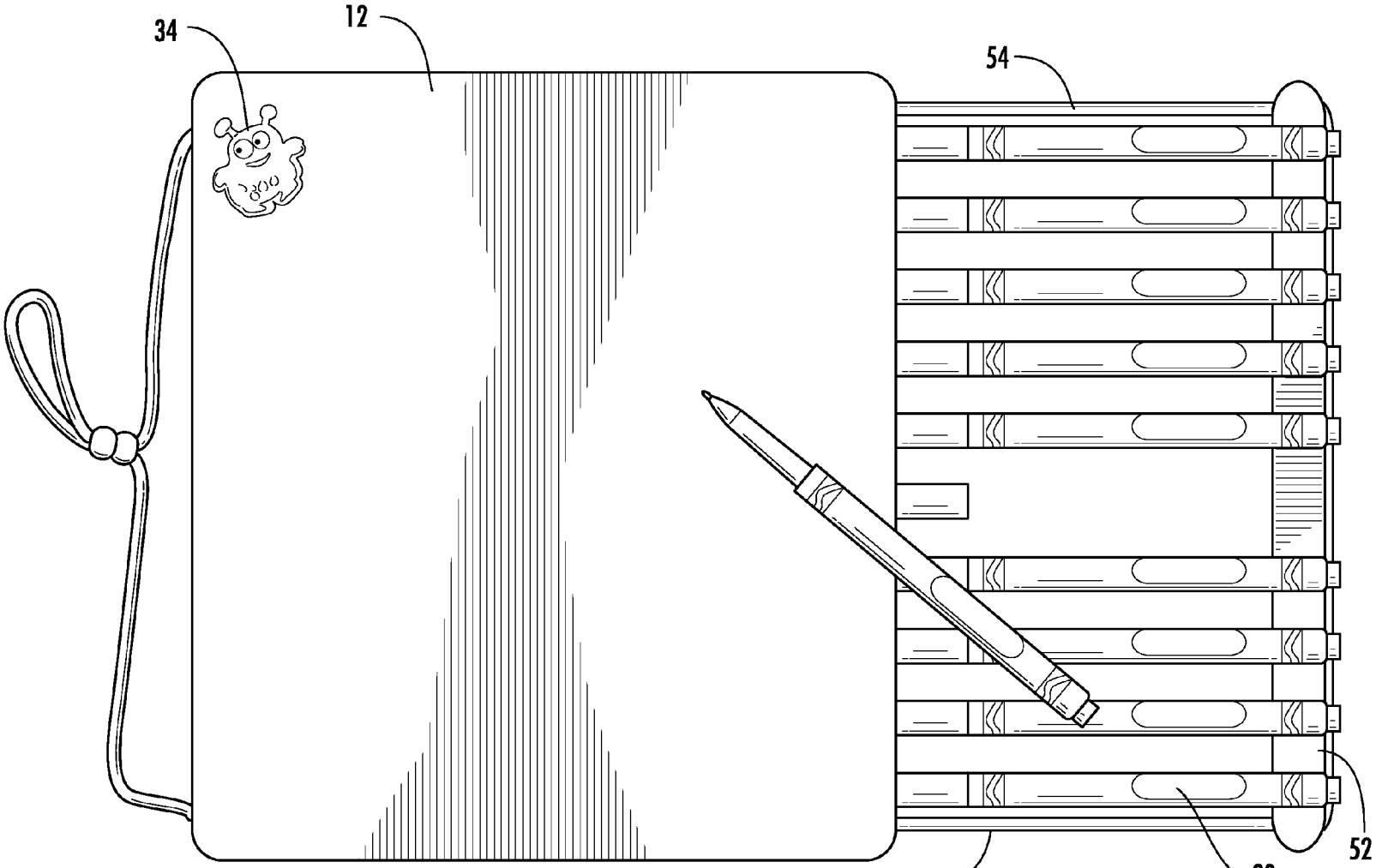
FIG. 14 is a front planar view of an alternative clip-less clipboard device, illustrating, in particular, a writing surface, tethered cord, and extendable marker holder, according to an embodiment of the technology described herein.

In at least one embodiment the clip-less clipboard device 10 also includes a marker pull-out tray 54, as depicted in FIGS. 13 and 14, configured to couple to the clipboard surface through one or more of the multiplicity of hollow channels 44 of the clipboard surface. The marker pull-out tray 54 includes handle or tab 52 by which to grip the marker pull-out tray 54 and pull it outwardly or push it inwardly. In at least one embodiment, the combined clipboard device 10 and pull-out marker tray 54 also includes a multiplicity of markers 28.

In at least one embodiment the clip-less clipboard device 10 also includes a multiplicity of crayons 43 contained and configured to couple to the clip-less clipboard device 10. As depicted, for example, in FIG. 4, the multiplicity of crayons 43 is shown depicted coupled to the clipboard front surface 12.

In at least one embodiment, the clip-less clipboard device 10 is of plastic. In at least one embodiment, the clip-less clipboard device 10 includes portions or corrugated plastic. In at least one embodiment, the clip-less clipboard device 10 is of a weight of less than five ounces.

In at least one embodiment the clip-less clipboard device 10 is entirely washable. In at least one embodiment the clip-less clipboard device 10 is sterile.

In another exemplary embodiment, a clip-less clipboard device 10 includes a breakaway tethering cord 18. For example, as depicted in FIG. 18, the cord 18 is a breakaway, pre-cut cord at cut 50. The breakaway, pre-cut cord 18 is coupled to the clipboard surface and configured to tether the clip-less clipboard device 10. Through at least one bead 20 the breakaway, pre-cut cord 18 is coupled to itself and by which a length of the cord 18 is adjusted. The cord 18 is adjustable in length by placement of the bead 22 along at a preferred destination along the cord 18. While in use, if a force pulls upon the clip-less clipboard device 10, the cord 18 will breakaway and disconnect to not injure the user.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. A clip-less clipboard device comprising:

a clipboard surface having:

a first planer surface area;

a second planar surface area generally parallel to the first surface area and generally equidistant apart from the first surface area at a predetermined distance;

a plurality of flutes disposed within the first surface area and the second surface area and generally perpendicular to the first surface area and the second surface area; and a corrugated core disposed within each of the plurality of flutes, thereby to create a plurality of hollow channels within the flutes within the first surface area and the second surface area, and wherein each channel runs a continuous length within the first surface area and the second surface area; and a slit defined on the first planer surface area of the clipboard surface and configured to hold an article of paper upon the first planer surface area.

2. The clip-less clipboard device of claim 1, further comprising:

a base coupled to a bottom surface area of the clipboard surface and at a generally perpendicular angle to the clipboard surface, and through at least one hollow channel, thereby configured to hold the clip-less clipboard device in an upright, stable position.

3. The clip-less clipboard device of claim 1, further comprising:

a cord, coupled to the clipboard surface and configured to tether the clip-less clipboard device; and at least one bead through which the cord is coupled to itself and by which a length of the cord is adjusted;

wherein the cord is adjustable in length by placement of the bead along at a preferred destination along the cord.

4. The clip-less clipboard device of claim 1, further comprising:

a pencil or pen holder defined within the plurality of hollow channels of the clipboard surface; and at least one pen or pencil disposed within at least one of the plurality of hollow channels of the clipboard surface.

5. The clip-less clipboard device of claim 1, further comprising:

a supplemental marker holder configured to couple to the clipboard surface through one or more of the plurality of hollow channels of the clipboard surface; and at least one marker for placement within a cavity of the supplemental marker holder.

6. The clip-less clipboard device of claim 1, further comprising:

a light disposed upon the clipboard surface and configured to provide illumination to a user of the clip-less clipboard device when in use.

7. The clip-less clipboard device of claim 1, further comprising:

a band configured for horizontal, circumnavigated placement around the clipboard surface and with which to secure one or more sheets of paper to the clip-less clipboard device in addition to the slit.

8. The clip-less clipboard device of claim 1, further comprising:

a straight edge.

9. The clip-less clipboard device of claim 8, wherein the straight edge is configured to couple to the clip-less clipboard device utilizing at least one of the hollow channels.

10. The clip-less clipboard device of claim 8, wherein the straight edge is configured to couple to the clip-less clipboard device utilizing the base.

11. The clip-less clipboard device of claim 8, wherein the straight edge further comprises a plurality of apertures such that the straight edge, along with at least one writing instrument is usable as a compass.

12. The clip-less clipboard device of claim 1, further comprising:

a ruler configured to couple to the clip-less clipboard device.

13. The clip-less clipboard device of claim 1, further comprising:

a marker pull-out tray configured to couple to the clipboard surface through one or more of the plurality of hollow channels of the clipboard surface.

14. The clip-less clipboard device of claim 1, further comprising:

a plurality of crayons contained and configured to couple to the clip-less clipboard device.

15. The clip-less clipboard device of claim 1, wherein the clip-less clipboard device is comprised of plastic.

16. The clip-less clipboard device of claim 1, wherein the clip-less clipboard device is entirely washable.

17. A clip-less clipboard device with breakaway tethering cord comprising:

a clipboard surface having:

a first planer surface area;

a second planar surface area generally parallel to the first surface area and generally equidistant apart from the first surface area at a predetermined distance;

a plurality of flutes disposed within the first surface area and the second surface area and generally perpendicular to the first surface area and the second surface area; and a corrugated core disposed within each of the plurality of flutes, thereby to create a plurality of hollow channels within the flutes within the first surface area and the second surface area, and wherein each channel runs a continuous length within the first surface area and the second surface area;

a slit defined on the first planer surface area of the clipboard surface and configured to hold an article of paper upon the first planer surface area;

a breakaway, pre-cut cord, coupled to the clipboard surface and configured to tether the clip-less clipboard device;

at least one bead through which the cord is coupled to itself and by which a length of the cord is adjusted;

wherein the cord is adjustable in length by placement of the bead along at a preferred destination along the cord; and wherein while in use a force pulls upon the clip-less clipboard device the cord will breakaway to not injure the user.

18. A combined clipboard device and pull-out marker tray comprising:

a clipboard surface having:

a first planer surface area;

a second planar surface area generally parallel to the first surface area and generally equidistant apart from the first surface area at a predetermined distance;

a plurality of flutes disposed within the first surface area and the second surface area and generally perpendicular to the first surface area and the second surface area; and a corrugated core disposed within each of the plurality of flutes, thereby to create a plurality of hollow channels within the flutes within the first surface area and the second surface area, and wherein each channel runs a continuous length within the first surface area and the second surface area;

a marker pull-out tray configured to couple to the clipboard surface through one or more of the plurality of hollow channels of the clipboard surface.

19. The combined clipboard device and pull-out marker tray of claim 18, further comprising:

a cord, coupled to the clipboard surface and configured to tether the clip-less clipboard device;

at least one bead through which the cord is coupled to itself and by which a length of the cord is adjusted;

wherein the cord is adjustable in length by placement of the bead along at a preferred destination along the cord.

20. The combined clipboard device and pull-out marker tray of claim 18, further comprising:

a plurality of markers.

* * * * *